United States Patent [19]

Eckstein

[11] 4,429,869

[45] Feb. 7, 1984

[54] SKIER'S EXERCISE DEVICE

[76] Inventor: Arthur Eckstein, 47 Pinetree La., Roslyn Heights, N.Y. 11577

[21] Appl. No.: 311,775

[22] Filed: Oct. 15, 1981

[51] Int. Cl.[3] ..... A63B 69/18

[52] U.S. Cl. ..... 272/97

[58] Field of Search ..... 272/97; 434/253; 128/25 R, 25 B

[56] References Cited

U.S. PATENT DOCUMENTS

| | | | |
|---|---|---|---|
| 3,374,782 | 3/1968 | Izzo | 272/97 X |
| 3,461,857 | 8/1969 | Poulin | 272/97 X |
| 3,582,066 | 6/1971 | Keryluk | 272/97 |
| 3,834,693 | 9/1974 | Poppenberger | 272/97 |

*Primary Examiner*—William H. Grieb

*Attorney, Agent, or Firm*—Shenier & O'Connor

[57] ABSTRACT

A skier's exercise device includes an inclined platform supporting a baseplate having four retaining walls within which a turntable is rotatably mounted. The turntable is formed with a pair of parallel spaced troughs adapted to rotatably receive a pair of support members. Each support member slidably receives a foot plate equipped with foot straps releasably securing the user's feet to the plates. Each of four retaining walls is formed with a slot adapted to receive the friction pad to engage the edge of the turntable to impede the rotation thereof.

5 Claims, 5 Drawing Figures

SKIER'S EXERCISE DEVICE

FIELD OF THE INVENTION

My invention relates to the field of exercise devices and more particularly to a skier's exercise and training device for conditioning the muscles and reflexes and developing the bodily coordination used to make parallel turns while skiing.

BACKGROUND OF THE INVENTION

There are known in the prior art various types of skier's exercise devices used to simulate the motions and conditions incident to making parallel turns, in which the skis are maintained parallel to each other, while shifting body weight from one ski to another, moving the uphill ski to a position forward of the downhill ski and edging the skis into the hill.

In one such device, disclosed in Izzo U.S. Pat. No. 3,374,782 issued Mar. 26, 1968, a skier wearing ski boots stands on two narrow platforms which are mechanically driven by a motor, via an appropriate gear and cam mechanism, through predetermined and prescribed angles to simulate parallel turns. While this device may simulate parallel turns, it does not teach the active coordination and total involvement of the body which initiates and executes each turn leading directly and immediately into the next. As the skier does not initiate any of the action, his muscles are not involved in generating the turns as in actual skiing. Hence, the muscular compression and extension required in actual parallel turning is absent. In addition, the skier is required to wear ski boots, which is an inconvenience. The gear and cam motor arrangement render this device inordinately expensive to manufacture and repair.

Poulin U.S. Pat. No. 3,461,857, issued Aug. 19, 1969, discloses another device in which a turntable, mounted for rotation on an inclined support plate, carries a pair of foot supports which are also connected to the support plate, upon which the skier stands. The turntable may then be rotated either by the skier or by an electric motor, moving the foot supports to simulate the positions of skis during parallel turns. While this device permits the skier to initiate the action, since the foot supports are in fixed positions relative to each other, it does not provide for the independent alternating fore-and-aft movement of each ski which occurs with each turn. Neither does Poulin provide for simulating the edging action which takes place in actual parallel turns. Poulin's foot supports are kept in a constant horizontal attitude in spite of the angle of the turntable plane. It will thus be seen that Poulin does not simulate the actual component movements of a parallel turn.

Still another device is disclosed in Poppenberger U.S. Pat. No. 3,834,693 issued Sept. 10, 1974 in which a pair of ski boot simulating devices, on which the skier stands, are secured by corresponding rotatable and vertically movable double hinges and cylinders to corresponding horizontal platforms. The platforms carry wheels which are received in the tracks of a pair of frames, permitting movement in a first horizontal direction. The frames also carry wheels, which are received in a main support track, permitting movement in a second horizontal direction perpendicular to the first. The main support track is secured to a disc which can be rotated in either direction in a horizontal plane about its center. While this device may simulate some of the movements associated with parallel turns, it fails to allow for the shifting of weight from one ski to another. It appears that if the proper pressure were exerted against either platform, it would slam shut or its wheels would leave the tracks. In addition, the double-hinged plates do not accurately simulate edging, as the hinge acts as the pivotal point in the edging action which is not the action of the skiis on snow. Moreover, the cylinder, which is intended to provide an up-and-down movement to the ski boot simulating device, also provides an additional rotation on a vertical axis extending through its center. This additional rotation may counteract the pressure applied during edging and prevent movement of the turntable.

Poppenberger's tiered arrangement also appears extremely precarious, presenting the possibility of accident to the user if, for example, one of the sixteen wheels should fail. This would also render the device useless, as would the failure of any of the four hinges or two cylinders. It should also be noted that the number of parts of this device render the cost of manufacture and assembly prohibitive, and, that special shoes must be worn by the user.

SUMMARY OF THE INVENTION

One object of my invention is to provide a skier's exercise device which accurately simulates the motions and conditions incident to making parallel turns while skiing.

Another object of my invention is to provide a skier's exercise device which can be used by individuals of varying sizes and ages.

Still another object of my invention is to provide a skier's exercise device which does not require the user to wear ski boots or special shoes.

A further object of my invention is to provide a skier's exercise device in which all movements are motivated by the user's actions.

A still further object of my invention is to provide a skier's exercise device which may be used to teach the novice or to condition the expert.

An additional object of my invention is to provide a skier's exercise device which may be adjusted to require more muscular exertion by the user or a more rapid response.

Another object of my invention is to provide a skier's exercise device which is inexpensive in construction.

Yet another object of my invention is to provide a skier's exercise device which overcomes the defects of the prior art.

Other and further objects of my invention will appear from the following description.

DESCRIPTION OF THE PREFERRED EMBODIMENT

Figure 1:
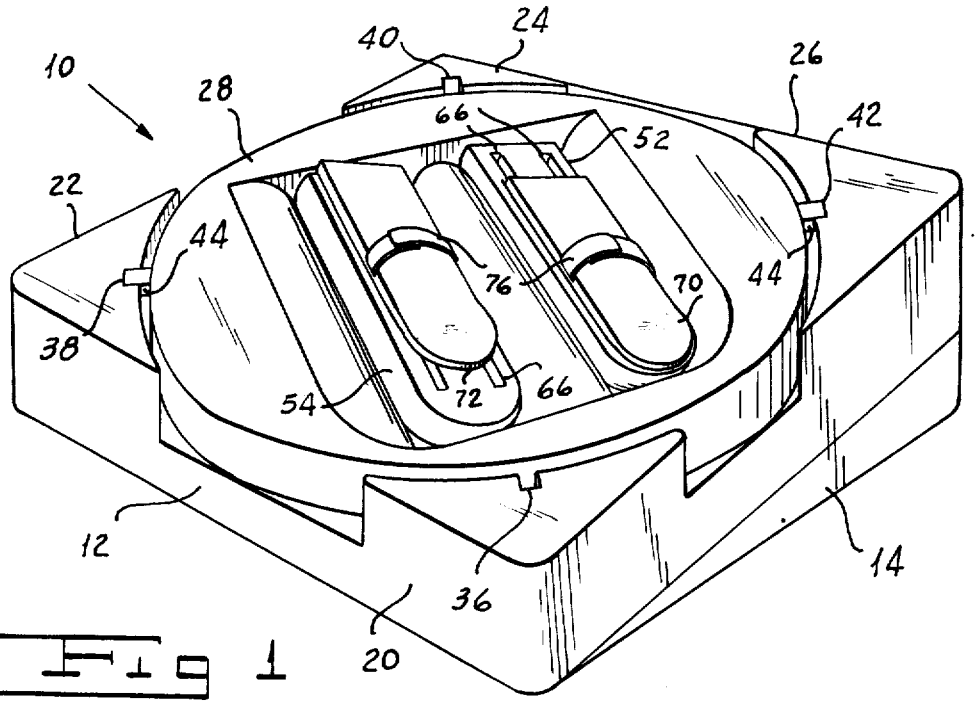
FIG. 1 is a perspective of my skier's exercise device.
Figure 4:
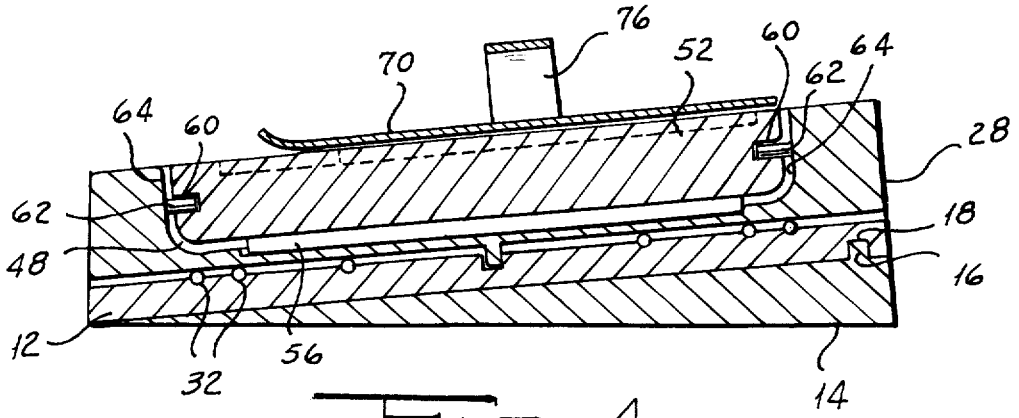
FIG. 4 is a section of my skier's exercise device taken along the lines 4—4 of FIG. 2.

Referring now to FIGS. 1 through 4, my skier's exercise device, indicated generally by the reference character 10, includes a generally rectangular or circular base plate 12 which may be placed directly on the ground or be used with a movable inclined platform 14. The platform establishes a five degree incline and is formed with a lug 16 adapted to be conformingly received in slot 18 located in the base plate 12, as shown in FIG. 4. The base plate 12 is formed with four generally triangular retaining walls 20, 22, 24, and 26 located at each of its four corners, defining a circular area for receiving a turntable 28. A turntable 28 is rotatably supported by a plurality of roller bearings 32. A pivot pin 34 on turntable 28 is received in an aperture 36, located in the center of the circular area, thus permitting rotary movement of the turntable 28 on a vertical axis extending through the center of the pivot pin 34.

As will be more fully described hereinbelow, rotation of the turntable 28 is initiated by the user as he simulates right-hand and left-hand turns. It is desirable to vary the amount of pressure required to rotate the turntable. To this end each of the retaining walls 20, 22, 24, and 26 is formed with a slot 36, 38, 40, and 42. Selected ones of the slots 36, 38, 40 and 42 receive friction pads 44 which engage the edge of turntable 28 to control the speed with which the turntable rotates. If for example, conditioning of the muscles used in edging is desired, more pads 44 are inserted so that more muscle exertion is required. For speed of response, however, pads 44 are removed so the device responds more rapidly to less forceful body action. Other means may be used to control the degree of response to body action, such as set screws (not shown) through retaining walls 20, 22, 24, and 26, which can be adjusted to increase the pressure upon the turntable 28.

Figure 3:
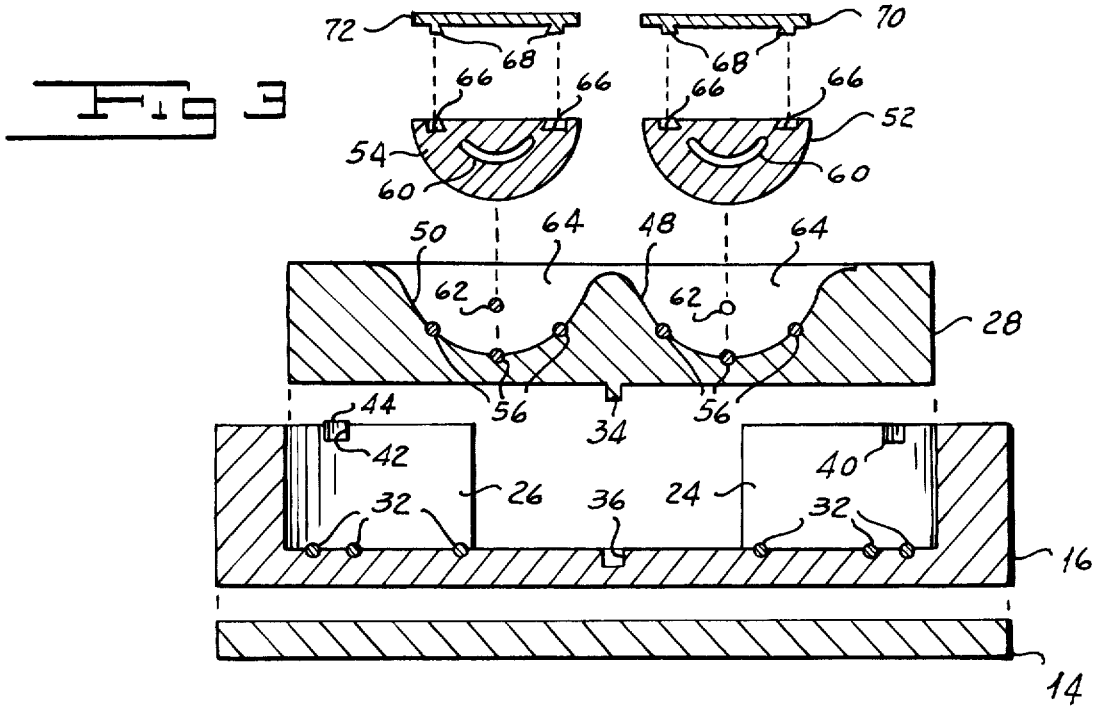
FIG. 3 is an exploded section of my skier's exercise device taken along the lines 3—3 of FIG. 2.
Figure 2:
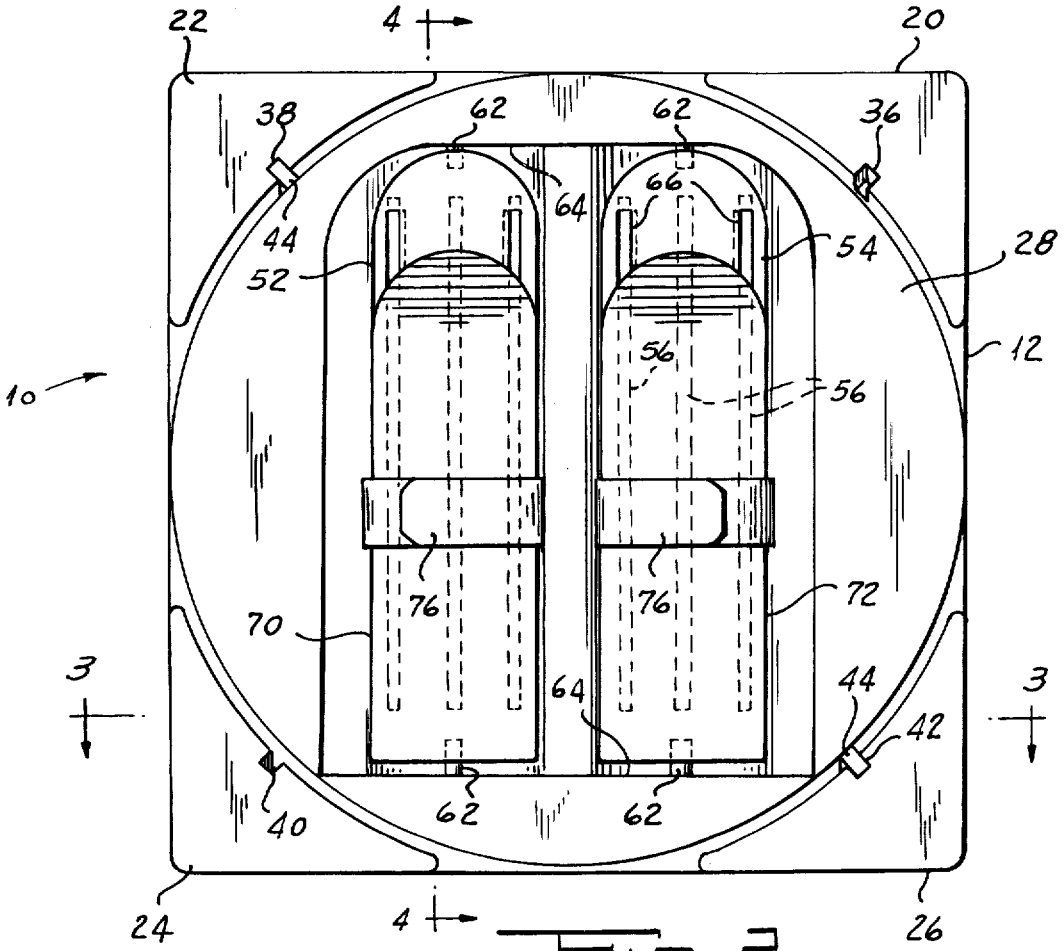
FIG. 2 is a top plan of my skier's exercise device.

As most clearly shown in FIG. 3, I form the turntable with a pair of parallel spaced troughs 48 and 50 of generally hemicylindrical cross section, which are adapted to receive respective elongated supports 52 and 54 of a cross-sectional configuration conforming to the troughs 48 and 50. These supports 52 and 54 rest on a plurality of floating rod bearings 56, running the length of the surface of the troughs 48 and 50, thus permitting rotary movement of the supports around parallel horizontal axes. In addition, at the ends of each support 52 and 54, I form respective channels 60 of generally arcuate shape for receiving retaining pins 62 protruding from the end walls 64 of the troughs. The pins 62 together with the channels 60 serve to guide the supports for rotary movement around the parallel axes and to retain the supports 52 and 54 in their respective troughs 48 and 50.

I form the upper surface of each support 52 and 54 with a pair of parallel elongated notches 66 of generally dovetailed cross section, running the lengths of the supports. The notches 66 are adapted slidably to receive similarly shaped runners 68 which are carried by the undersides of a pair of footplates 70 and 72 to permit fore-and-aft movement of the plates 70 and 72 relative to supports 52 and 54. The user places his feet on the plates, which are adapted to simulate skis.

Figure 5:
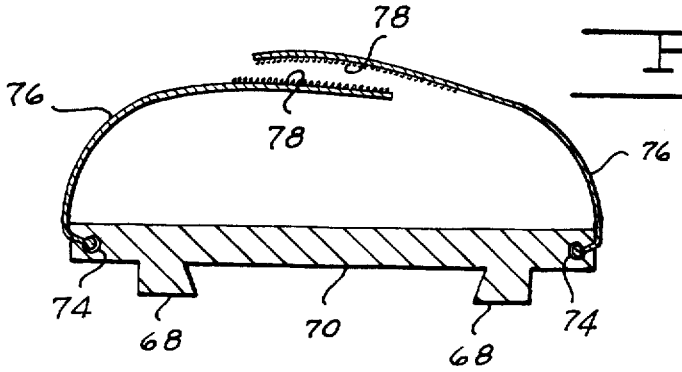
FIG. 5 is a section of one foot plate of my skier's exercise device, drawn on an enlarged scale.

As best shown in FIG. 5, I form the sides of each foot plate 70 with a mushroom shaped recess 74 running the length of the plate. Each recess 74 is adapted to receive and retain one end of a nylon footstrap 76, the opposite end of which includes an adjustable two-part fastener 78 such as that manufactured and sold under the trademark "VELCRO" by the American Velcro Company. It will be readily appreciated that the use of an adjustable binding, together with the ability of the straps to be moved along the chambers 74 toward either end of the plates 70 and 72 allows any size foot to be accommodated. Other strapping devices may be used to accomplish the same flexibility in accommodating different size feet. For instance, two straps, one to secure the heel of the foot and one to secure the instep may be attached to swivel retainers mounted to the sides of the foot plate 70, giving a wide range of adjustability.

My skier's exercise device is used to strengthen the muscles and quicken the reflexes needed and used to make parallel turns while skiing. The skier or user may be barefoot or wear socks or sneakers, and may use his own ski poles to which rubber tips have been attached, so as not to mar the floor. During parallel turns the skis are to be maintained parallel to each other during the entire turn and are to be edged into the hill during the traverse portion of the turn. In addition, it is necessary to simultaneously shift body weight from one ski to another, together with independent alternating fore-and-aft movement of each ski for each turn, so that the uphill ski moves to a position forward of the downhill ski. My device insures that the plates 70 and 72, simulating skis, are kept parallel to each other at all times as they are connected to supports 52 and 54 which rest in parallel spaced troughs 48 and 50. Also, as the supports 52 and 54 are rotatable within the troughs 48 and 50 as described above, edging, the rotation of the ski on a generally horizontal axis more or less parallel to the slope of the hill, is accurately simulated. In addition, the degree of edging is infinitely variable in my device, as it depends entirely on the skier's motion and can be controlled by him to meet a variety of training, learning and conditioning objectives. I have also provided for the fore-and-aft movement of each ski through the use of runners 68 connected to the underside of the foot plates 70 and 72, which are slidably received in notches 66 located on the supports 52 and 54.

It will be readily appreciated that while all movements of my device are facilitated by bearings, they are generated by the skier's bodily action. In no sense is the movement of turning mechanically produced by my device. The action of unweighting for example, essential to shifting the weight from one ski (footplate) to another, is accomplished solely by the movement of the skier. If he does not do it, he will not be able to turn.

The major components of my device may easily be molded from a suitable synthetic resin. My device is easy to assemble and is highly resistant to damage.

It will be seen that I have accomplished the objects of my invention. I have provided a skier's exercise device which accurately simulates the motions and conditions incident to making parallel turns while skiing. My device may be used by individuals of varying ages and sizes without ski boots or special shoes. All movements of my device are motivated by the user and may be used to teach the novice or condition the expert. In addition, my device may be adjusted to require more muscular exertion by the user or more rapid response. Moreover, my device is inexpensive in construction.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Skier's exercise apparatus including in combination a turntable formed with a pair of generally parallel spaced elongated troughs, means mounting said turntable for rotary movement around a pivot axis located between said troughs, a pair of intermediate supports, means mounting said supports in said troughs for rotary movement around axes extending generally longitudinally of said troughs, a pair of foot-receiving plates, and means mounting said plates respectively on said supports for fore-and-aft sliding movement in the direction of said support axes.

2. Skier's exercise apparatus including in combination a base formed with a generally circular recess, a generally circular turntable formed with a pair of generally parallel spaced elongated troughs, means mounting said turntable in said recess for rotary movement around a pivot axis located between said troughs, a pair of intermediate supports, means mounting said supports in said troughs for rotary movement around respective axes extending generally in the direction of the lengths of said troughs, a pair of foot-receiving plates, and means mounting said plates respectively on said supports for fore-and-aft sliding movement in the direction of said support axes.

3. Apparatus as in claim 2 including adjustable means for impeding the rotary movement of said turntable.

4. Apparatus as in claim 3 in which said impeding means comprises interengageable means on the wall of said recess.

5. Apparatus as in claim 2 in which said turntable is inclined from horizontal.

* * * * *